US006467462B2

(12) United States Patent
Boecking

(10) Patent No.: US 6,467,462 B2
(45) Date of Patent: Oct. 22, 2002

(54) FUEL INJECTION SYSTEM FOR INTERNAL COMBUSTION ENGINES

(75) Inventor: Friedrich Boecking, Stuttgart (DE)

(73) Assignee: Robert Bosch GmbH, Stuttgart (DE)

( * ) Notice: Subject to any disclaimer, the term of this patent is extended or adjusted under 35 U.S.C. 154(b) by 6 days.

(21) Appl. No.: 09/741,070

(22) Filed: Dec. 21, 2000

(65) Prior Publication Data

US 2001/0013337 A1 Aug. 16, 2001

(30) Foreign Application Priority Data

Dec. 28, 1999 (DE) ..... 199 63 390

(51) Int. Cl.[7] ..... F02M 37/04
(52) U.S. Cl. ..... 123/506; 123/514
(58) Field of Search ..... 123/506, 498, 123/499, 514, 461, 490, 467, 458

(56) References Cited

U.S. PATENT DOCUMENTS 3,742,918 A * 7/1973 Murtin et al. ..... 123/32 EA
4,393,847 A * 7/1983 May ..... 123/502
4,838,232 A * 6/1989 Wich ..... 123/506
5,036,821 A * 8/1991 Horiuchi et al. ..... 123/506
5,235,490 A * 8/1993 Frank et al. ..... 361/154
6,253,736 B1 * 7/2001 Crofts et al. ..... 123/498

* cited by examiner

*Primary Examiner*—Willis R. Wolfe
*Assistant Examiner*—Mahmoud Gimie
(74) *Attorney, Agent, or Firm*—Ronald E. Greigg

(57) ABSTRACT

For each cylinder of the internal combustion engine, the fuel injection system has one fuel pump, one fuel injection valve, and one line connecting the fuel injection valve to the fuel pump. To control the injection, a first electrically triggerable control valve is disposed on the fuel pump, by which valve a communication of the high-pressure side of the fuel pump with a relief chamber is controlled. The onset of fuel injection is determined by the closing time of the first control valve, by which the high-pressure side is disconnected from the relief chamber. Near the fuel injection valve, a second electrically triggerable control valve is disposed, by which a communication of the fuel volume, located in the fuel injection valve, with a relief chamber is controlled. The end of the fuel injection is determined by the opening time of the second control valve, and as a result rapid relief of the fuel volume located in the fuel injection valve and thus rapid closure of the fuel injection valve are achieved.

20 Claims, 2 Drawing Sheets

FUEL INJECTION SYSTEM FOR INTERNAL COMBUSTION ENGINES

FIELD OF THE INVENTION

The invention is based on a fuel injection system for internal combustion engines.

BACKGROUND OF THE INVENTION

One such fuel injection system is known from the literature, for instance from the textbook Dieselmotor-Management [Diesel Engine Management], 2nd Edition, Verlag Vieweg, page 299. For each cylinder of the engine, this fuel injection system has one fuel pump, one fuel injection valve, and one line connecting the fuel injection valve to the fuel pump. An electrically controlled control valve is disposed on the fuel pump and by the control valve a communication of the high-pressure side of the fuel pump with a relief chamber is controlled. In a known manner, the fuel injection valve has an injection valve member, by which at least one injection opening is controlled, and which has a pressure shoulder defining a pressure chamber; the pressure chamber communicates with the line, and the injection valve member can be lifted from a valve seat, counter to a closing force for opening the at least one injection opening, by fuel under high pressure delivered to the pressure chamber by the fuel pump. By means of the control valve, the time and duration of opening of the fuel injection valve can be controlled; the time of opening is determined by the disconnection of the high-pressure side of the fuel pump from the relief chamber by the control valve, and thus the high pressure generated by the fuel pump acts at the fuel injection valve. For closing the fuel injection valve, the communication of the high-pressure side of the fuel pump with the relief chamber is opened by the control valve, so that high pressure that would open the fuel injection valve is no longer operative in the fuel injection valve. The control valve is disconnected by the line and is located relatively far away from the fuel injection valve, so that when the communication of the high-pressure side of the fuel pump with the relief chamber is opened, the pressure in the pressure chamber of the fuel injection valve drops only in delayed fashion, and the fuel injection valve correspondingly closes only with a delay, so that the closing time and thus the duration of opening of the fuel injection valve can be determined only imprecisely. A brief opening of the fuel injection valve for a preinjection is likewise feasible only with difficulty, because of the delayed pressure change at the fuel injection valve. Varying the course of the opening stroke of the injection valve member of the fuel injection valve, in order to attain a certain course of the quantity of injected fuel during the opening duration of the fuel injection valve, is likewise feasible only with difficulty in the known fuel injection system.

OBJECT AND SUMMARY OF THE INVENTION

The fuel injection system according to the invention has the advantage over the prior art that fast closure of the fuel injection valve without any delay is assured by the second control valve. Also by the second control valve, a brief opening duration of the fuel injection valve is attainable, as is required for a preinjection, for instance. Furthermore, the opening stroke of the injection valve member can be varied by means of the second control valve.

The invention will be better understood and further objects and advantages thereof will become more apparent from the ensuing detailed description of a preferred embodiment taken in conjunction with the drawing.

DESCRIPTION OF THE PREFERRED EMBODIMENT

Figure 1:
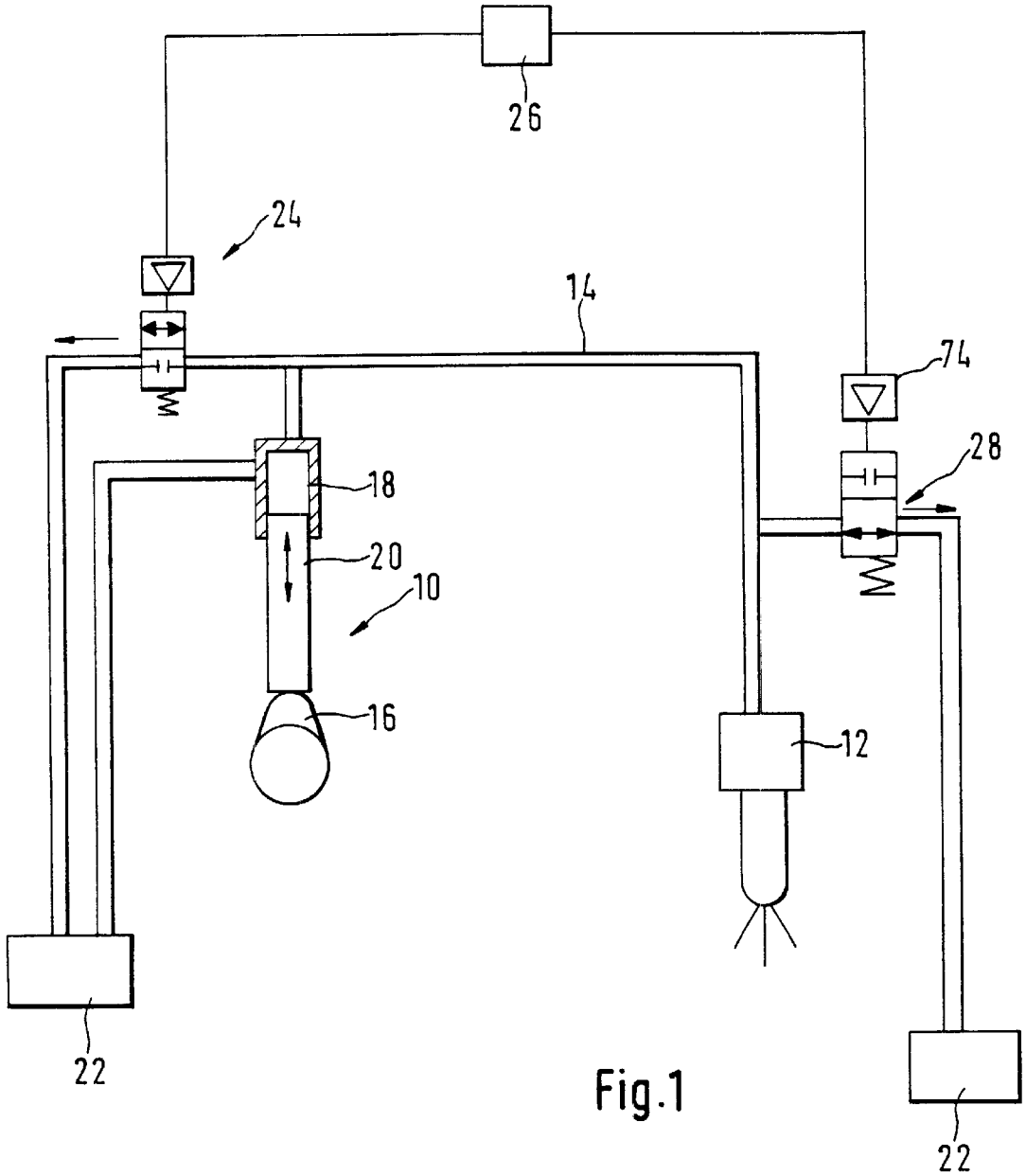
FIG. 1 shows a fuel injection system in a schematic illustration.

A fuel injection system, shown in FIG. 1, for internal combustion engines is embodied as a so-called unit pump system. For each cylinder of the engine, the fuel injection system has one fuel pump 10, one fuel injection valve 12, and one line 14 connecting the fuel injection valve 12 to the fuel pump 10. The fuel pump 10 is driven for example by a cam 16 of a camshaft of the engine. The fuel pump 10 has a piston 20, guided tightly in a cylinder 18, by which piston, in its reciprocating motion effected by the cam 16, fuel is compressed in the cylinder. In a manner not shown, for instance by a prefeed pump, fuel is delivered to the fuel pump 10 from a tank 22.

A first control valve 24 is disoposed on the fuel pump 10 and by it a communication of the high-pressure side of the fuel pump 10 with a relief chamber is controlled. The tank 22, or a chamber communicating with it, can for instance serve as the relief chamber. The first control valve 24 is triggerable electrically and is preferably connected to an electric control unit 26. When the control valve 24 is closed, the high-pressure side of the fuel pump 10 is disconnected from the relief chamber 22, so that high pressure prevails in the line 14 and in the fuel injection valve 12. When the first control valve 24 is opened, the high-pressure side of the fuel pump 10 communicates with the relief chamber 22, and high pressure cannot build up in the line 14 and the fuel injection valve 12, since fuel can flow out into the relief chamber 22 via the opened control valve 24. The control valve 24 can have an electromagnet as its actuator, for instance, or a piezoelectric actuator. According to the invention, either near the fuel injection valve 12 in the line 14 or integrated with the fuel injection valve 12, a second electrically triggerable control valve 28 is provided, by which once again a communication with a relief chamber, such as the tank 22, is controlled.

The fuel injection valve 12 will now be described in further detail, referring to FIG. 2. The fuel injection valve 12 has a valve body 30, which can be embodied in multiple parts, and in which a piston like injection valve member 32 is guided axially displaceably. On its end region oriented toward the combustion chamber of the engine cylinder, the valve body 30 has at least one and preferably a plurality of injection openings 34. The injection valve member 32, on its end region toward the combustion chamber, has a sealing face 36, for instance of conical shape, which cooperates with a valve seat 38 embodied in the valve body 30; from the valve seat or downstream of it, the injection openings 34 lead away. An annular chamber 42 surrounding the injection valve member 32 is embodied in the valve body 30 and communicates with a pressure chamber 44. The injection valve member 32 has a pressure shoulder 46 that defines the pressure chamber 44. The injection valve member 32 is engaged by a closing spring 48, by which the injection valve member 32 is pressed toward the valve seat 38. In the valve body 30, a conduit 50 is embodied, which leads away from the pressure chamber 44 and extends along the injection valve member 32 and the closing spring 48 and discharges at the outer jacket of the valve body 30. The line 14 that originates at the fuel pump 10 is connected to the orifice of the conduit 50 in a manner not shown in detail.

Figure 2:
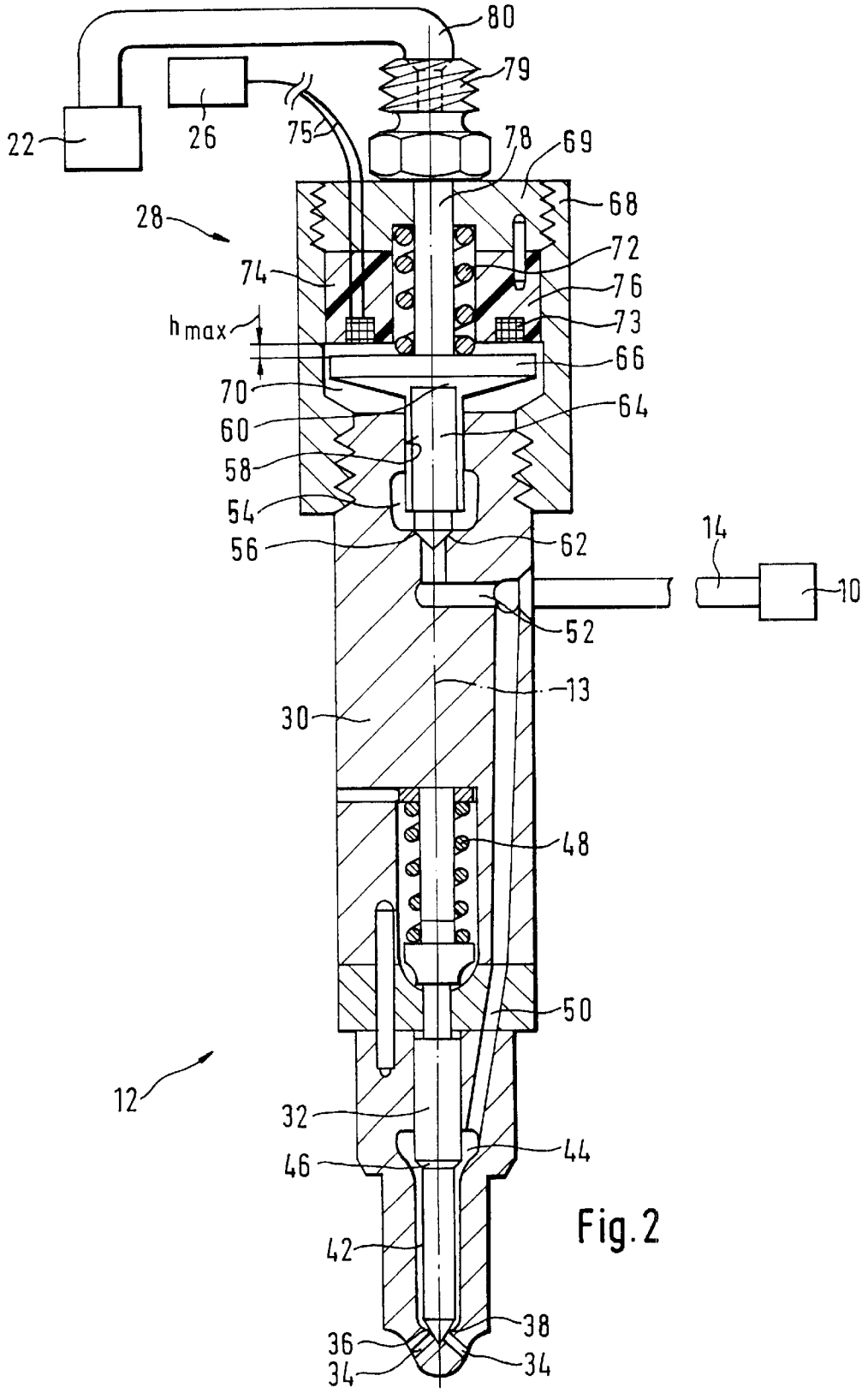
FIG. 2 shows a fuel injection valve of the fuel injection system in an enlarged longitudinal section.

In the exemplary embodiment shown in FIG. 2, the second control valve 28 is disposed on the fuel injection valve 12. A further conduit 52 communicating with the conduit 50, for instance near its orifice, is provided in the valve body 30; it extends for instance from the conduit 50 approximately radially to the longitudinally axis 13 of the fuel injection valve 12 and then approximately coaxially to the longitudinal axis 13. The conduit 52 can be formed by bores in the valve body 30, for instance. The conduit 52 discharges in the valve body 30 into a chamber 54 of widened cross section compared with the conduit 52; at its orifice, the conduit 52 is chamfered approximately conically, for instance, thus forming a valve seat 56. Opposite the conduit 52, a bore 58 leads away from the chamber 54, extending approximately coaxially to the conduit 52; its cross section can be the same as or larger than the cross section of the conduit 52.

The second control valve 28 has a control valve member 60, which is guided axially displaceably in the bore 58 of the valve body 30 and which protrudes with its end region into the chamber 54. The end of the control valve member 60 protruding into the chamber 54 has a conical chamfer, for instance, which forms a sealing face 62 with which the control valve member 60 cooperates with the valve seat 56. The portion of the control valve member 60 guided in the bore 58 can have one or more flat faces 64 and/or grooves, so that a free cross section remains between the control valve member 60 and the bore 58. On its end protruding out of the bore 58 and pointing away from the chamber 54, the control valve member 60 has a flange 66 of enlarged cross section.

A closure part 68 is seated on the end region, remote from the combustion chamber, of the valve body 30. The closure part 68 can for instance be screwed to the valve body 30 or connected to it in some other way. A chamber 70 is embodied in the closure part 68, and the flange 66 of the control valve member 60 is disposed in this chamber; a free cross section remains between the flange 66 and the closure part 68 in the chamber 70, and for this purpose the flange 66 has one or more openings or grooves, and/or the closure part 68 has one or more grooves. A prestressed closing spring 72 is disposed, at least coaxially to the control valve member 60, between the bottom 69 of the closure part 68 and the flange 66 of the control valve member 60; by means of this spring, the control valve member 60 is pressed against the valve seat 56. An electrically triggerable actuator 74 is also disposed in the closure part 68, and by means of the actuator, given suitable electrical triggering, the control valve member 60 can be moved away from the valve seat 56, counter to the force of the closing spring 72. By way of example, the actuator 74 can be an electromagnet; a coil 73 is disposed in the closure part 68, and the flange 66 of the control valve member 60 acts as a magnet armature. The control valve member 60, or at least its flange 66, comprises ferromagnetic material. When current flows through the coil 73 of the electromagnet, this creates a magnetic field, which attracts the flange 66 to the coil 73, thus lifting the control valve member 60 from the valve seat 56. The magnetic force acting on the flange 66 of the control valve member 60 is dependent on the intensity of the current flowing through the coil 73, so that by varying the current intensity, the magnetic force acting on the flange 66 of the control valve member 60, and thus the position of the control valve member 60, can be varied. Electric lines 75 for connecting the actuator 74 to the control unit 26 by which the actuator 74 is triggered are extended through the closure part 68. The actuator 74 can be embedded in the closure part 68 in an insulating potting composition 76. The maximum stroke of the control valve member 60 is limited by the provision that this member comes to rest with its flange 66 on either the coil 73 or the potting composition 76. The bottom 69 of the closure part 68 has a bore 78, which is at least approximately coaxial to the closing spring 72. A connection neck 79 is disposed on the outside of the bottom 69 of the closure part 68, and a line 80 leading to a relief chamber, such as the tank 22, is connected to this neck.

Instead of an electromagnet, a piezoelectric actuator can also be used as the actuator. A piezoelectric actuator changes its length when an electrical voltage is applied, thus creating an adjusting force for a motion of the control valve member 60 away from the valve seat 56. The piezoelectric actuator can act on the control valve member 60 either directly or preferably via a hydraulic step-up, which boosts the relatively slight change in length of the piezoelectric actuator. By varying the magnitude of the electrical voltage applied to the piezoelectric actuator, its change in length can be adjusted in an infinitely varied way.

The mode of operation of the fuel injection valve 12 and the second control valve 28 will now be explained. When the first control valve 24 is closed, high pressure is generated in the line 14 and thus at the fuel injection valve 12 by the fuel pump 10. When the second control valve 28 is closed, or in other words when its control valve member 60 rests with its sealing face 62 on the valve seat 56, the high pressure of the line 14 is also operative, via the conduit 50, in the pressure chamber 44. The pressure prevailing in the pressure chamber 44 acts on the pressure shoulder 46 of the injection valve member 32, and if this pressure is high enough, then as a result of it the injection valve member 32 is moved away from the valve seat 38, counter to the force of the closing spring 48, and opens the injection openings 34, through which fuel is injected into the combustion chamber. To terminate the injection, the second control valve 28 is opened; that is, its control valve member 60 is moved away from the valve seat 56. The conduit 50 then communicates, via the conduit 52, the opened valve seat 56, the chamber 54, the cross section remaining between the control valve member 60 and the bore 58, and the chamber 70, bore 78 and neck 79, with the line 80 leading to the relief chamber 22, so that high pressure, by which the fuel injection valve 12 could be opened or kept opened, can no longer build up there. By means of the second control valve 28, the fuel volume located in the fuel injection valve 12, or in other words the fuel volume that is located in the conduit 50, in the pressure chamber 44, in the annular chamber 42, and in the conduit 52, can be made to communicate directly with the relief chamber 22. As a result, fast, delay-free opening and closing of the fuel injection valve 12 is assured. This is advantageous especially to enable a preinjection, in which by means of a brief opening of the fuel injection valve 12 only a slight fuel quantity is injected.

The instant of injection onset can be determined for instance by the first control valve 24, by closing it. The instant of the end of injection is determined by the second control valve 28, that is, by opening it. The first control valve 24 is also opened simultaneously with or shortly after the second control valve 28, so that by means of the second control valve 28, only a slight fuel quantity needs to flow out, and the flow cross sections in it can be kept relatively small. The course of the fuel quantity over time that is injected when the fuel injection valve 12 is open can also be varied by the second control valve 28. This is done in that the control valve member 60, between its sealing face 62 and the valve seat 56, uncovers a flow cross section which is dependent on the length of the stroke of the control valve member 60. For instance, it can be provided that at the onset of injection, the second control valve 28 is somewhat open, and the control valve member 60 does not execute its full stroke but rather only a partial stroke. This can be accomplished by suitably triggering the actuator 74, or in other words with a low current intensity if the actuator is embodied as an electromagnet, or with low voltage if the actuator is embodied as a piezoelectric actuator. In that case, a small fuel quantity can flow out via the open second control valve 28 into the relief chamber 22, so that the pressure prevailing in the pressure chamber 44 of the fuel injection valve 12 is less than the maximum pressure when the second control valve 28 is closed, and so the fuel injection through the injection openings 34 takes place at a slighter pressure and with a correspondingly slighter quantity. In the further course of the injection, the second control valve 28 can be closed, so that the maximum pressure prevails in the pressure chamber 44 and the injection takes place with the maximum quantity. This kind of course of the injection quantity, with a reduced quantity at the onset of the injection event, is also known as a boot injection.

The foregoing relates to a preferred exemplary embodiment of the invention, it being understood that other variants and embodiments thereof are possible within the spirit and scope of the invention, the latter being defined by the appended claims.

I claim:

1. A fuel injection system for internal combustion engines, with one fuel pump (10), one fuel injection valve (12), and one line (14) connecting the fuel injection valve (12) to the fuel pump (10), each for each cylinder of the engine, in which a first electrically triggerable control valve (24) is connected with the fuel pump (10), by which valve a communication of the high-pressure side of the fuel pump (10) with a relief chamber (22) is controlled, and the fuel injection valve (12) has an injection valve member (32), by which at least one injection opening (34) is controlled and which has a pressure shoulder (46) defining a pressure chamber (44), and the pressure chamber (44) communicates with the line (14), and the injection valve (32) is lifted from a valve seat (38), counter to a closing force for opening the at least one injection opening (34), by fuel under pressure delivered to the pressure chamber (44) by the fuel pump when the first electrically triggerable control valve (24) is closed, a second electrically triggerable control valve (28) is disposed near the fuel injection valve (12), by which second electrically triggerable control valve communication of the fuel volume located in the fuel injection valve (12) with a relief chamber (22)is controlled, and thus closing the at least one opening (34).

2. The fuel injection system of claim 1, in which the first electrically triggerable control valve (24) is disposed in the line (14).

3. The fuel injection system of claim 1, in which the second control valve (28) is disposed on the fuel injection valve (12).

4. The fuel injection system of claim 3, in which the fuel injection valve (12) has a valve body (40), in which at least one conduit (50) for connecting the pressure chamber (44) to the line (14) is embodied, and that the communication of the conduit (50) with the relief chamber (22) is controlled by the second control valve (28).

5. The fuel injection system of claim 1, in which the outflow cross section in communication with the relief chamber (22) can be adjusted by the second electrically triggerable control valve (28).

6. The fuel injection system of claim 2, in which the outflow cross section in communication with the relief chamber (22) can be adjusted by the second electrically triggerable control valve (28).

7. The fuel injection system of claim 3, in which the outflow cross section in communication with the relief chamber (22) can be adjusted by the second electrically triggerable control valve (28).

8. The fuel injection system of claim 4, in which the outflow cross section in communication with the relief chamber (22) can be adjusted by the second electrically triggerable control valve (28).

9. The fuel injection system of claim 1, in which the second control valve (28) has an electromagnetic actuator (74).

10. The fuel injection system of claim 2, in which the second control valve (28) has an electromagnetic actuator (74).

11. The fuel injection system of claim 3, in which the second control valve (28) has an electromagnetic actuator (74).

12. The fuel injection system of claim 4, in which the second control valve (28) has an electromagnetic actuator (74).

13. The fuel injection system of claim 5, in which the second control valve (28) has an electromagnetic actuator (74).

14. The fuel injection system of claim 1, in which the second control valve (28) has a piezoelectric actuator (74).

15. The fuel injection system of claim 4, in which the second control valve (28) has a piezoelectric actuator (74).

16. The fuel injection system of claim 5, in which the second control valve (28) has a piezoelectric actuator (74).

17. The fuel injection system of claim 1, in which the injection onset is determined by the closing time of the first control valve (24), and that an end of injection is determined by an opening time of the second control valve (28).

18. The fuel injection system of claim 4, in which the injection onset is determined by the closing time of the first control valve (24), and that an end of injection is determined by an opening time of the second control valve (28).

19. The fuel injection system of claim 5, in which the injection onset is determined by the closing time of the first control valve (24), and that an end of injection is determined by an opening time of the second control valve (28).

20. The fuel injection system of claim 17, in which at the end of injection, the first control valve (24) is opened simultaneously with or shortly after the second control valve (28).

* * * * *